US010638911B2

(12) United States Patent
Thiyagarajan et al.

(10) Patent No.: US 10,638,911 B2
(45) Date of Patent: May 5, 2020

(54) HEATING ASSEMBLY FOR A WASHING APPLIANCE

(71) Applicant: Haier US Appliance Solutions, Inc., Wilmington, DE (US)

(72) Inventors: Ramasamy Thiyagarajan, Louisville, KY (US); Adam Christopher Hofmann, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 155 days.

(21) Appl. No.: 15/664,304

(22) Filed: Jul. 31, 2017

(65) Prior Publication Data

US 2019/0029492 A1 Jan. 31, 2019

(51) Int. Cl.

| | |
|---|---|
| ***A47L 15/42*** | (2006.01) |
| ***F28D 15/02*** | (2006.01) |
| ***A47L 15/50*** | (2006.01) |
| ***A47L 15/22*** | (2006.01) |
| ***A47L 15/46*** | (2006.01) |

(52) U.S. Cl.

CPC ..... *A47L 15/4285* (2013.01); *A47L 15/22* (2013.01); *A47L 15/4221* (2013.01); *A47L 15/4293* (2013.01); *A47L 15/46* (2013.01); *A47L 15/502* (2013.01); *A47L 15/507* (2013.01); *F28D 15/02* (2013.01); *F28D 15/025* (2013.01); *F28D 15/0275* (2013.01)

(58) Field of Classification Search

CPC .. A47L 15/22; A47L 15/4221; A47L 15/4285; A47L 15/4293; A47L 15/46; A47L 15/502; A47L 15/507; F28D 15/025; F28D 15/02; F28D 15/0275

See application file for complete search history.

(56) References Cited

U.S. PATENT DOCUMENTS

| | | | | |
|---|---|---|---|---|
| 8,603,260 | B2 | 12/2013 | Classen et al. | |
| 9,113,766 | B2 * | 8/2015 | Tuller | A47L 15/0047 |
| 2007/0102028 | A1 * | 5/2007 | Yoon | A47L 15/4204 134/56 D |
| 2012/0227926 | A1 * | 9/2012 | Field | F24D 11/003 165/10 |

(Continued)

FOREIGN PATENT DOCUMENTS

| | | | | |
|---|---|---|---|---|
| FR | 2491321 | A1 | 4/1982 | |
| JP | 2006247267 | A * | 9/2006 | |
| JP | 2007117556 | A * | 5/2007 | A47L 15/4285 |

OTHER PUBLICATIONS

Abstract of JP2006-247267A (Year: 2006).*
Abstract of JP2007-117556A (Year: 2007).*

*Primary Examiner* — Douglas Lee
(74) *Attorney, Agent, or Firm* — Dority & Manning, P.A.

(57) ABSTRACT

A dishwashing appliance includes a tub defining a wash chamber. The dishwashing appliance also includes a fluid circulation system configured to deliver fluid to the wash chamber. The fluid circulation system includes a heating element in operative communication with at least one component of the fluid circulation system. The dishwashing appliance also includes a heat pipe heat exchanger having a condenser section and an evaporator section. The condenser section is in operative communication with the wash chamber and the evaporator section is in operative communication with the heating element of the fluid circulation system.

11 Claims, 4 Drawing Sheets

(56) References Cited

U.S. PATENT DOCUMENTS

2013/0319482 A1 12/2013 Vallejo Noriega et al.
2013/0333238 A1* 12/2013 Thiyagarajan ..... A47L 15/48
34/476

* cited by examiner

HEATING ASSEMBLY FOR A WASHING APPLIANCE

FIELD

The present subject matter relates generally to washing appliances, such as dishwashing appliances and, more particularly, to a heating assembly of a washing appliance.

BACKGROUND

Dishwashing appliances generally include a tub that defines a wash chamber. Rack assemblies can be mounted within the wash chamber for receipt of articles for washing. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles. As is generally understood, dishwashing appliances may often include multiple spray-arm assemblies, such as a lower spray-arm assembly mounted to the tub at a bottom of the wash chamber, a mid-level spray-arm assembly mounted to one of the rack assemblies, and/or an upper spray-arm assembly mounted to the tub at a top of the wash chamber.

Moreover, dishwashing appliances are typically equipped with a fluid circulation system including a plurality of fluid circulation components for directing fluid to the spray-arm assemblies. Specifically, a pump is typically housed within a machine compartment of the dishwasher that is configured to pump fluid along a circulation flow path for subsequent delivery to the spray-arm assemblies. For example, the fluid discharged from the pump may be routed through a diverter assembly and/or one or more fluid conduits disposed along the circulation flow path prior to being delivered to the spray-arm assemblies.

To provide for desired cleaning performance, the fluid directed through the fluid circulation system is often heated. Such heating of the fluid can be accomplished with integrated heating rods or other resistive heating element in the components of the fluid circulation system, such as by integrating such heating elements into the circulation pump. However, the integration of heating element(s) within the fluid circulation component generally precludes using such heating elements for heating air, e.g., to provide heat for the drying cycle, thus necessitating one or more additional heating elements for the drying cycle.

Accordingly, an improved heating system for a washing appliance that addresses one or more of the issues highlighted above in the prior art, e.g., which permits a hidden heating element integrated with one or more fluid circulation components to provide heating in both wet cycle and drying cycle, would be welcomed in the technology.

BRIEF DESCRIPTION

Aspects and advantages of the invention will be set forth in part in the following description, or may be obvious from the description, or may be learned through practice of the invention.

In one aspect, the present subject matter is directed to a dishwashing appliance. The dishwashing appliance includes a tub defining a wash chamber. The dishwashing appliance also includes a fluid circulation system configured to deliver fluid to the wash chamber. The fluid circulation system includes a heating element in operative communication with at least one component of the fluid circulation system. The dishwashing appliance also includes a heat pipe heat exchanger having a condenser section and an evaporator section. The condenser section is in operative communication with the wash chamber and the evaporator section is in operative communication with the heating element of the fluid circulation system.

In another aspect, the present subject matter is directed to a method of operating a dishwashing appliance. The method includes flowing a liquid into a wash chamber of the dishwashing appliance. The method also includes activating a circulation pump of a fluid circulation system to circulate the liquid throughout the wash chamber and activating a heating element at a first level when the circulation pump is activated. The heating element is in operative communication with a component of the fluid circulation system, thereby heating the liquid. The method then includes deactivating the circulation pump and deactivating the heating element. The method also includes draining the liquid from the wash chamber. The method also includes activating the heating element at a second level after draining the liquid from the wash chamber and transferring heat from the heating element to the wash chamber via a heat pipe heat exchanger.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
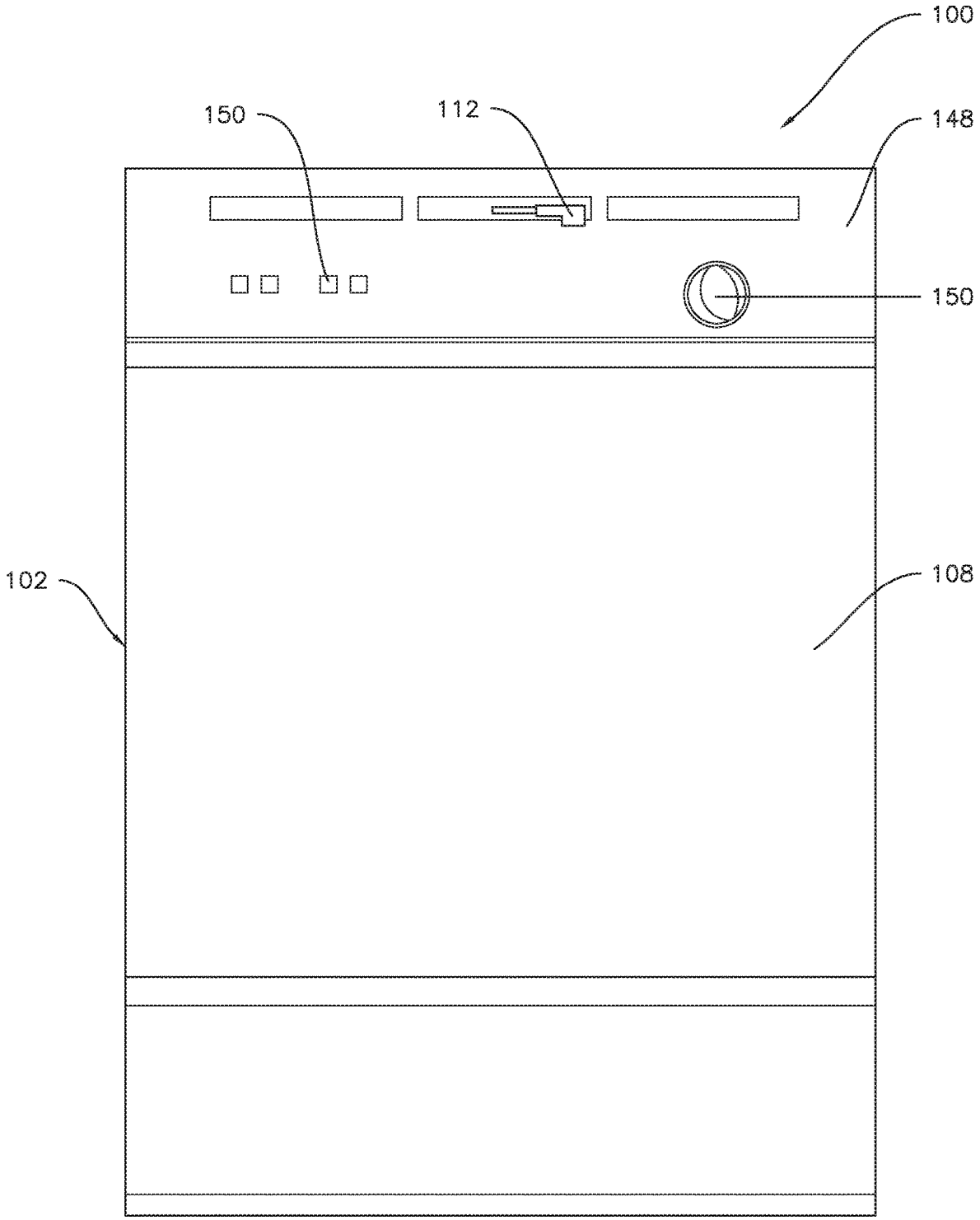
FIG. 1 illustrates a front view of one embodiment of a dishwashing appliance in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
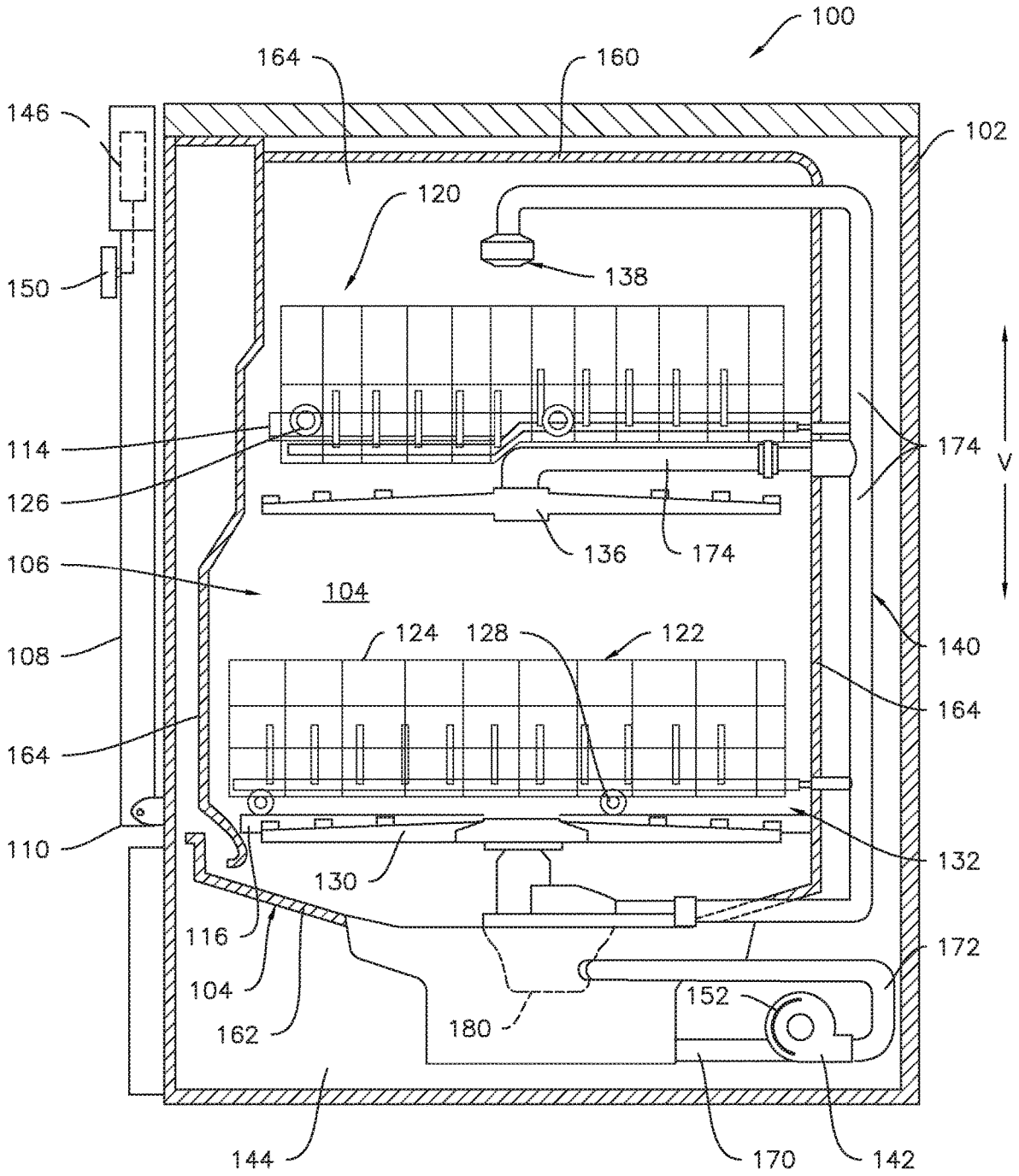
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 112 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 114, 116 may be mounted on opposing side walls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack is substantially positioned outside the wash chamber 106, and a retracted position (shown in FIGS. 1 and 2) in which the rack is located inside the wash chamber 106. This may be facilitated by rollers 126 and 128, for example, mounted onto racks 120 and 122, respectively. As is generally understood, a silverware basket (not shown) may be removably attached to rack assembly 122 for placement of silverware, utensils, and the like, that are otherwise too small to be accommodated by the racks 120, 122.

Additionally, the dishwashing appliance 100 may also include a lower spray-arm assembly 130 that is configured to be rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation system 140 for circulating fluid (e.g., water and dishwasher fluid) within the tub 104. As shown in FIG. 2, the fluid circulation system 140 may also include a pump 142 located in a machinery compartment 144 below the bottom wall 162 of the tub 104, as is generally recognized in the art, and one or more fluid conduits for circulating the fluid delivered from the pump 142 to and/or throughout the wash chamber 106. For example, as shown in FIG. 2, first and second pump conduits 170, 172 may be in fluid communication with the pump 142, with the first pump conduit 170 being configured to deliver fluid to the pump 142 and the second pump conduit 172 being configured to deliver the fluid from the pump 142 to a diverter assembly 180 of the fluid circulation system 140. In addition, one or more fluid conduits may be positioned downstream of the diverter assembly 180 for directing fluid to one or more of the spray arm assemblies 130, 136, 138. For example, as shown in FIG. 2, a fluid conduit 174 may be in fluid communication with the diverter assembly 180 for directing fluid to the mid-level and upper spray arm assemblies 136, 138.

Additionally, features for heating the fluid may be provided in the fluid circulation system 140. A heating element may be provided in operative communication with one or more components of the fluid circulation system 140. For example, the heating element may be provided in operative communication with one of the first and second pump conduits 170 or 172 or fluid conduit 174. As illustrated for example in FIGS. 2 and 3, an inline heating element 152 (sometimes also referred to as an "inline heater") may be provided in operative communication with the pump 142, e.g., the inline heating element 152 may be provided as a resistance heating element such as a heating rod which is integrated with and at least partially encircles the pump 142.

Moreover, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a washing spray.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of the dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. As is generally understood, the user interface 150 may be in communication with the controller 146 via one or more signal lines or shared communication busses. It should be noted that controllers 146 as disclosed herein are capable of and may be operable to perform any methods and associated method steps as disclosed herein.

As indicated above, the fluid recirculation system 140 may also include a diverter assembly 180 in fluid communication with the pump 142. In general, the diverter assembly 180 may be configured to divert fluid between one or more of the spray-arm assemblies 130, 136, 138. For example, in one embodiment, the diverter assembly 180 may include a first outlet (not shown) for directing fluid received from the pump 142 to the lower spray-arm assembly 130 and a second outlet (not shown) for directing the fluid received from the pump 142 to the mid-level and upper spray-arm assemblies 136, 138 (e.g., via the conduit 174). In such an embodiment, the diverter assembly 180 may also include a diverter valve (not shown) for diverting the flow of fluid through the assembly 180 to either its first outlet or its second outlet.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 150, different configurations may be provided for the racks 120, 122, and other differences may be applied as well.

Figure 3:
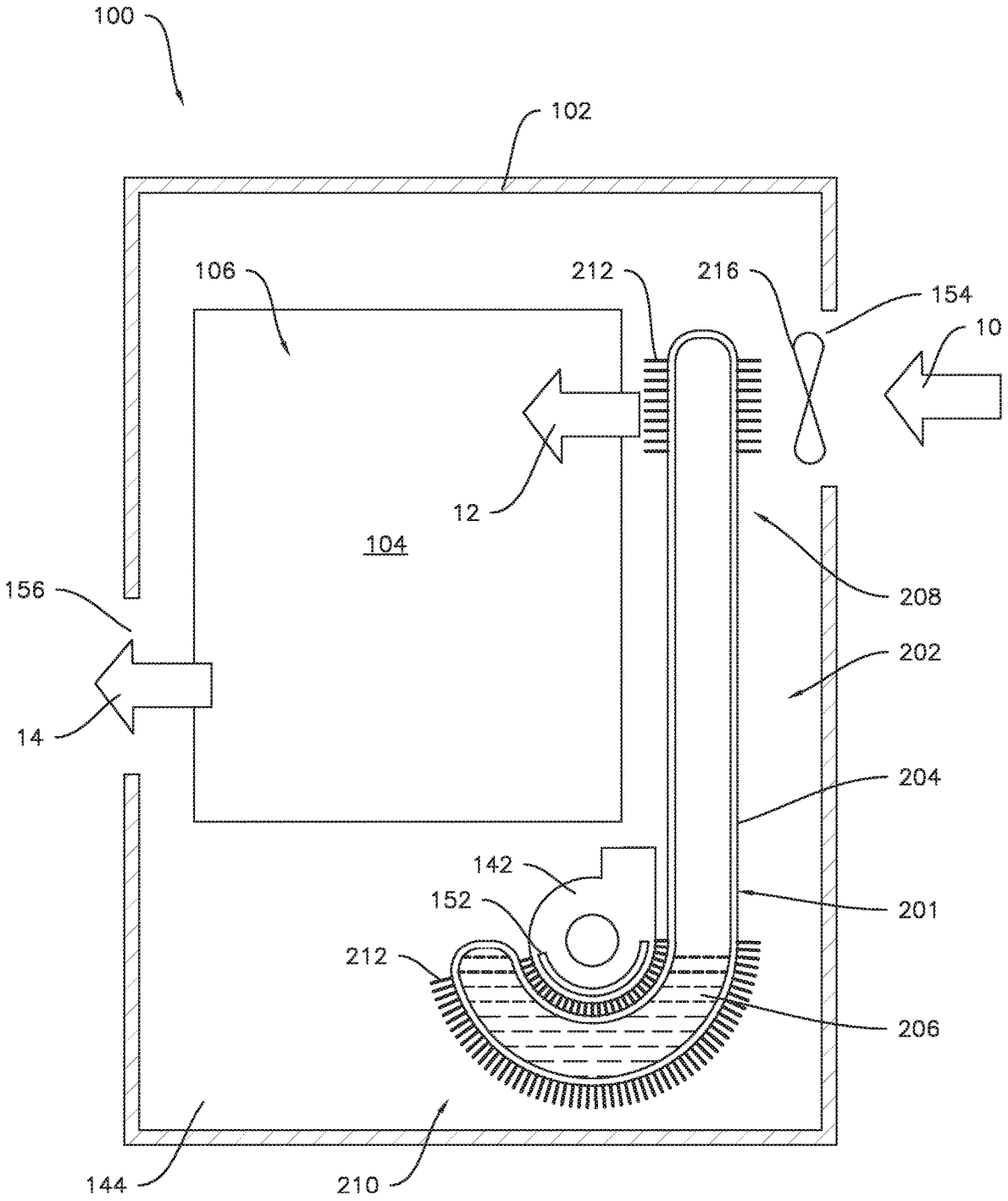
FIG. 3 illustrates a schematic view of a heating system for a dishwashing appliance according to one or more embodiments of the present disclosure.

For example, FIG. 3 illustrates an embodiment of dishwashing appliance 100 including an inlet 154 for receiving ambient air 10 and an outlet 156 through which exhaust air 14 may flow from the dishwashing appliance 100 to the ambient environment around the dishwashing appliance. The tub 104 may be in fluid communication with the ambient environment around the dishwashing appliance 100 via the inlet 154. As such, air may flow from the ambient environment, through the inlet 154, through the wash chamber 106 within tub 104, and then through the outlet 156. As used herein, "upstream" and "downstream" are with respect to the flow of air through the dishwashing appliance 100. Accordingly, for example, the outlet 156 is downstream of the wash chamber 106 and the inlet 154, and the wash chamber 106 is upstream of the outlet 156 and downstream of the inlet 154. As used herein, the ambient environment refers to the area externally around the dishwashing appliance 100, e.g., the ambient environment in close proximity to an exterior of the dishwashing appliance 100, such as the immediate surroundings of the dishwashing appliance 100 from which air may be drawn directly into the inlet 154.

As illustrated in FIG. 3, the dishwashing appliance 100 may include a heat pipe heat exchanger 202, sometimes referred to herein as a "heat pipe." As shown in FIG. 3, the heat pipe 202 includes a sealed casing 204 containing a working fluid 206 in the casing 204. The casing 204 is preferably constructed of a material with a high thermal conductivity, such as a metal, such as copper or aluminum. In some embodiments, the working fluid 206 may be water. In other embodiments, suitable working fluids for the heat pipe 202 include acetone, methanol, ethanol, or toluene. Any suitable fluid may be used for working fluid 206, e.g., any fluid that is compatible with the material of the casing 204 and is suitable for the desired operating temperature range. The heat pipe 202 extends between a condenser section 208 and an evaporator section 210. The working fluid 206 contained within the casing 204 of the heat pipe 202 absorbs thermal energy at the evaporator section 210, whereupon the working fluid 206 travels in a gaseous state from the evaporator section 210 to the condenser section 208. At the condenser section 208, the gaseous working fluid 206 condenses to a liquid state and thereby releases thermal energy. In particular embodiments, a fan or blower, such as intake fan 216 described hereinbelow, may be provided proximate to the condenser section 208 and configured to flow air around the condenser section 208, thus providing an increased rate of thermal transfer as compared to stagnant air, e.g., air that is not provided with motive force by the fan or blower. A plurality of fins 212 may be provided on an external surface 201 of the casing 204 at each of the condenser section 208 and the evaporator section 210. The fins 212 may provide an increased contact area between the heat pipe 202 and air flowing around the heat pipe 202, e.g., at the condenser section 208, for improved transfer of thermal energy. The fins 212 at the evaporator section 210 may serve as a heat sink to provide improved transfer of thermal energy from heating element 152 to the heat pipe 202.

The heat pipe 202 may include an internal wick structure (not shown) to transport liquid working fluid 206 from the condenser section 208 to the evaporator section 210 by capillary flow. In some embodiments, the heat pipe 202 may be constructed and arranged such that the liquid working fluid 206 returns to the evaporator section 210 solely by gravity flow. For example, the dishwasher appliance 100 may be constructed such that the heat pipe 202 may be arranged along the vertical direction V with the condenser section 208 positioned above the evaporator section 210 such that condensed working fluid 206 in a liquid state may flow from the condenser section 208 to the evaporator section 210 by gravity. In such embodiments, where the liquid working fluid 206 may return to the evaporator section 210 by gravity, the wick structure may be omitted.

The heat pipe 202 may generally provide heat transfer from the machinery compartment 144, and in particular from a heating element in operative communication with a component of the fluid circulation system 104 (FIG. 2) therein, to the wash chamber 106. Accordingly, the condenser section 208 may be in operative communication with the wash chamber 106 and the evaporator section 210 may be in operative communication with the heating element, e.g., inline heating element 152 of pump 142. For example, the condenser section 208 may be proximate the wash chamber 106 and the evaporator section 210 may be proximate the inline heating element 152 of pump 142. Still with reference to FIG. 3, the evaporator section 210 of the heat pipe 202 may absorb thermal energy from the heating element 152, whereupon gaseous working fluid 206 travels to the condenser section 208. In such embodiments, the condenser section 208 of the heat pipe 202 may be positioned proximate to the inlet 154 upstream of the wash chamber 106. As noted above, "upstream" means the condenser section 208 may be upstream of the wash chamber 106 with respect to the flow direction of air flowing from the ambient environment into the wash chamber 106 via the inlet 154, as indicated by arrows 10, 12, and 14. Accordingly, the working fluid 206 may condense in the condenser section 208 and thereby impart thermal energy to the incoming ambient air 10 such that hot air 12 is provided to the wash chamber 106. As used herein, "hot air" includes air having a temperature higher than an ambient temperature. For example, the ambient temperature may range from about 65° F. to about 85° F. Accordingly, "hot air" may be at least about 90° F., such as at least about 150° F., such as between about 200° F. and about 250° F., such as between about 215°

F. and about 235° F., such as about 225° F. As used herein, terms of approximation, such as "generally," or "about" include values within ten percent greater or less than the stated value. For example, "about 225° F." includes from 202.5° F. to 247.5° F.

As illustrated for example in FIG. 3, an intake fan 216 may be provided proximate the inlet 154 and upstream of the condenser section 208. Thus, where the inlet 154 is in fluid communication with the ambient atmosphere, ambient air 10 may pass through inlet 154, e.g., the ambient air 10 may be urged from the ambient environment through the inlet 154 by intake fan 216, such that the ambient air 10 passes over and around the condenser section 208 to provide a flow of hot air 12 to the wash chamber 106.

Figure 4:
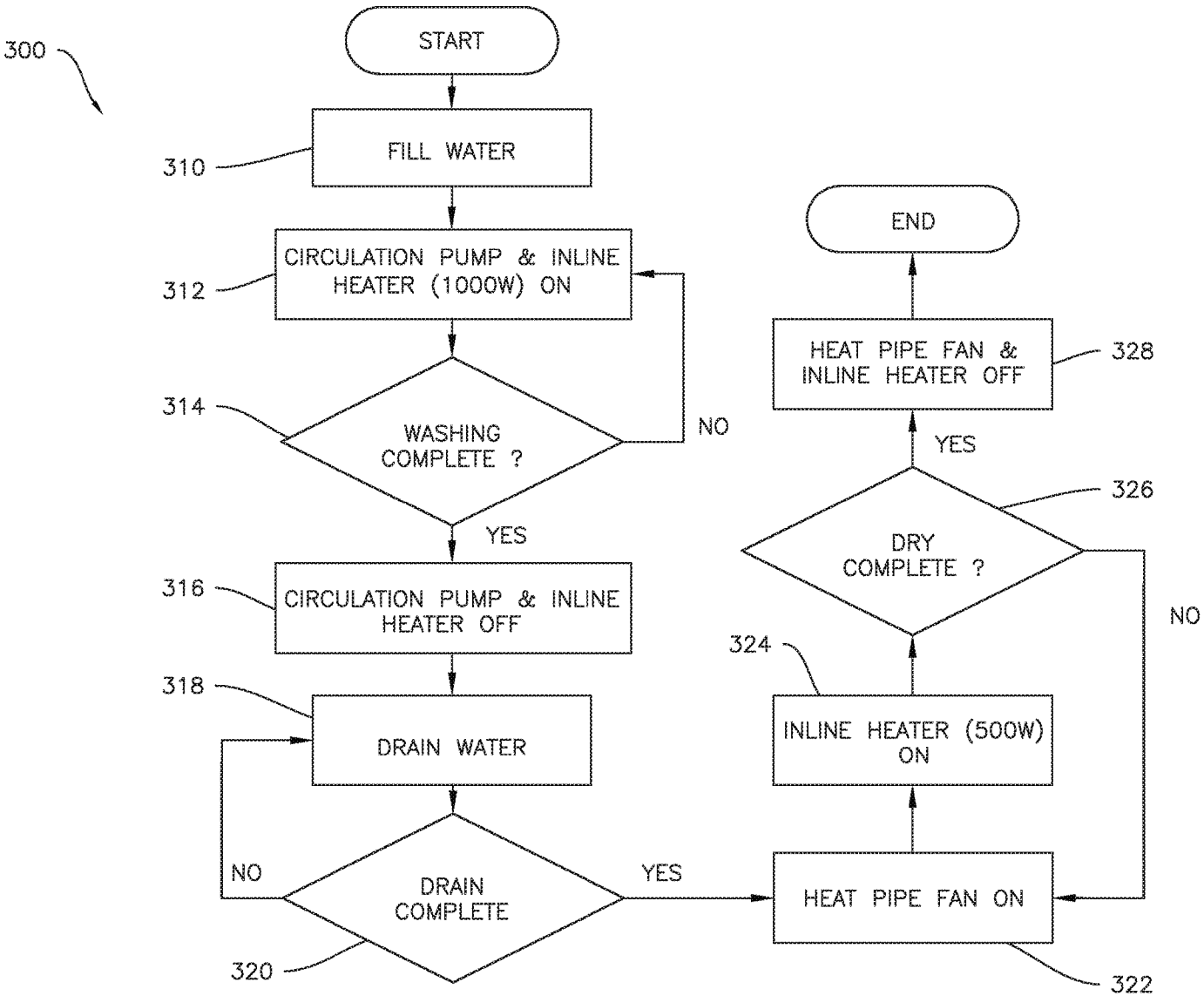
FIG. 4 illustrates a flow diagram of an exemplary method of operating a dishwashing appliance according to one or more embodiments of the present disclosure.

FIG. 4 illustrates an exemplary method 300 of operating a dishwashing appliance, such as dishwashing appliance 100. As illustrated, method 300 includes an initial fill water step 310. The fill water step 310 may include flowing a liquid into the wash chamber 106 of the dishwashing appliance 100. Method 300 may further include a step 312 of activating the circulation pump 142 of the fluid circulation system 140 to circulate the liquid throughout the wash chamber 106. Step 312 may also include activating a heating element, e.g., the inline heater 152. For example, in some embodiments, step 312 may include activating the heating element at a first level, such as about one thousand Watts (1000 W), when the circulation pump 142 is activated. As noted above, the heating element may be in operative communication with a component of the fluid circulation system 140, such as the pump 142. Therefore, where step 312 includes activating the heating element, the step 312 also includes heating the liquid. At step 314, method 300 includes determining that the washing is complete. Accordingly, a wash cycle of the dishwashing appliance 100 may generally comprise steps 310, 312, and 314.

Method 300 may further include a step 316 of deactivating the circulation pump 142 and the heating element, e.g., inline heater 152. Method 300 may then include a drain water step 318. For example, a drain pump (not shown) may be activated to drain the liquid from the wash chamber 106. At step 320, method 300 includes determining that the drain is complete. Method 300 then includes a heat pipe fan on step 322. For example, the heat pipe fan on step 322 may include urging ambient air 10 from the ambient environment around the dishwashing appliance 100 through the inlet 154 of the dishwashing appliance 100 and across the condenser section 208 of the heat pipe heat exchanger 202 with the intake fan 216. As noted above, urging the ambient air 10 across the condenser section 208 of the heat pipe heat exchanger 202 may provide increased thermal transfer from the condenser section 208, such that activating the intake fan 216 may also activate the heat pipe 202, e.g., by promoting the transfer of heat from the condenser section 208 to the ambient air 10 and condensation of the working fluid 206 within the condenser section 208. The method 300 may also include activating the heating element 152 at a second level after draining the liquid from the wash chamber 106 at step 324. For example, the first level may be greater than the second level, such as where activating the heating element 152 at the first level comprises activating the heating element 152 at about one thousand Watts (1000 W), activating the heating element 152 at the second level may comprise activating the heating element 152 at about five hundred Watts (500 W). Generally, the circulation pump 142 is not activated after draining the liquid from the wash chamber 106 at step 324, e.g., the circulation pump 142 is not activated when the heating element 152 is activated at the second level. In various embodiments, the method 300 may include step 322 of activating the intake fan 216 after draining the liquid from the wash chamber 106 and/or before activating the heating element 152 at the second level in step 324. As described above, when the heating element 152 is activated at the second level and the intake fan 216 is activated, the method 300 may thereby include transferring heat from the heating element 152 to the wash chamber 156 via the heat pipe heat exchanger 202, e.g., where the heat pipe heat exchanger 202 includes evaporator section 210 in operative communication with the heating element 152 and condenser section 208 downstream of the inlet 154 and upstream of the wash chamber 106. At step 326, method 300 includes determining that the drying is complete, e.g., that articles such as dishes within the wash chamber 106 are dry, for example based on a set amount of time programmed into the controller 146. Method 300 may further include a step 328 of deactivating the intake fan 216 and the heating element, e.g., inline heater 152.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a tub defining a wash chamber;

a fluid circulation system configured to deliver fluid to the wash chamber, the fluid circulation system comprising a pump and a heating element integrated with the pump; and a heat pipe heat exchanger comprising a condenser section and an evaporator section, the condenser section in operative communication with the wash chamber, the evaporator section at least partially surrounding the pump and heating element of the fluid circulation system.

2. The dishwashing appliance of claim 1, wherein the tub is in fluid communication with an ambient environment around the dishwashing appliance via an inlet, and the condenser section of the heat pipe heat exchanger is proximate the inlet upstream of the wash chamber with respect to a flow direction of air flowing from the ambient environment into the wash chamber via the inlet.

3. The dishwashing appliance of claim 2, further comprising an intake fan proximate the inlet configured to urge air from the ambient environment through the inlet.

4. The dishwashing appliance of claim 1, further comprising a cabinet, the tub positioned within the cabinet, the heating element positioned in a machinery compartment outside of the tub within the cabinet.

5. The dishwashing appliance of claim 1, wherein the heating element is an inline heating element integrated with the pump.

6. The dishwashing appliance of claim 1, wherein the heat pipe heat exchanger comprises a sealed casing and a working fluid contained within the sealed casing.

7. The dishwashing appliance of claim 6, wherein the dishwashing appliance defines a vertical direction, the condenser section of the heat pipe heat exchanger positioned above the evaporator section of the heat pipe heat exchanger along the vertical direction such that condensed working fluid flows from the condenser section to the evaporator section by gravity.

8. The dishwashing appliance of claim 6, wherein the heat pipe heat exchanger comprises a first plurality of fins on an external surface of the casing at the condenser section and a second plurality of fins on the external surface of the casing at the evaporator section.

9. The dishwashing appliance of claim 6, wherein the working fluid comprises water.

10. The dishwashing appliance of claim 6, wherein the sealed casing comprises a copper material.

11. The dishwashing appliance of claim 6, further comprising an internal wick structure positioned in the heat pipe heat exchanger to transport the working fluid from the condenser section to the evaporator section by capillary flow.

* * * * *